US007746240B2

(12) United States Patent
Vij

(10) Patent No.: US 7,746,240 B2
(45) Date of Patent: Jun. 29, 2010

(54) SENSING SYSTEM AND COMPONENTS FOR DETECTING AND REMOTELY MONITORING CARBON MONOXIDE IN A SPACE OF CONCERN

(75) Inventor: Ashok K. Vij, Tucson, AZ (US)

(73) Assignee: CO Guardian LLC

( * ) Notice: Subject to any disclaimer, the term of this patent is extended or adjusted under 35 U.S.C. 154(b) by 838 days.

(21) Appl. No.: 11/288,716

(22) Filed: Nov. 29, 2005

(65) Prior Publication Data

US 2007/0120693 A1 May 31, 2007

(51) Int. Cl.
*G08B 17/10* (2006.01)

(52) U.S. Cl. ..... 340/632; 340/945; 340/540

(58) Field of Classification Search ..... 340/632, 340/945, 540

See application file for complete search history.

(56) References Cited

U.S. PATENT DOCUMENTS 4,860,223 A * 8/1989 Grilk ..... 340/632
5,276,434 A * 1/1994 Brooks et al. ..... 340/632
5,879,631 A * 3/1999 Wewers et al. ..... 422/98
6,208,256 B1 * 3/2001 Fleming et al. ..... 340/632
6,433,696 B1 * 8/2002 Deiterman et al. ..... 340/632

(Continued)

OTHER PUBLICATIONS

WO 01/37231 A2 Garrett, James I,, Jr. Carbon Monoxide Detector For Air Vehicles. (May 25, 2001).*

(Continued)

*Primary Examiner*—Benjamin C Lee
*Assistant Examiner*—Eric M Blount
(74) *Attorney, Agent, or Firm*—Lawrence R. Oremland, P.C.

(57) ABSTRACT

A sensing device for detecting the presence of carbon monoxide in a selected space of concern and communicating with a remote monitoring device is provided. The sensing device comprises (a) a detection device configured to sense the presence of carbon monoxide in the selected space of concern, (b) a monitoring device remote from the detection device, for communicating information to an operator, and (c) the detector in circuit communication with the monitoring device, to transmit information from the detection device to the monitoring device that is related to carbon monoxide in the selected space. According to one preferred embodiment, the sensing device is designed for an aircraft. The remote monitoring device is the multifunctional display of the aircraft cockpit. In addition, in a preferred embodiment, a reset/retest actuator is connected with the multifunctional display, and is in circuit communication with the detection device. The reset/retest actuator is selectively actuated from the multifunctional display to send a reset/retest signal to the detection device, to reset the detection device, and to initiate operation of the detection device to repeat its carbon monoxide detection process and provide a signal related to the level of carbon monoxide detected by the detection device. Moreover, in a preferred embodiment, a heating element is provided that is proximate to the carbon monoxide detection component. The heating element is selectively actuated to heat the air space about the carbon monoxide detection component. Also, an adjustment device associated with the output of the CO detection device, for adjusting the output of the detection device in response to a signal related to the air pressure in the selected space of concern. These features are particularly useful in a detection device for an aircraft, where ambient temperatures may drop to levels that can adversely affect the performance of the detection device, or where pressure changes in the aircraft may affect the sensitivity of the detection device.

23 Claims, 13 Drawing Sheets

C O Detector Installation Wiring Diagram

U.S. PATENT DOCUMENTS

| | | | | |
|---|---|---|---|---|
| 6,930,599 | B2 * | 8/2005 | Naidoo et al. | 340/539.1 |
| 6,989,757 | B2 * | 1/2006 | Geoffrey J. et al. | 340/632 |
| 7,102,504 | B2 * | 9/2006 | Kates | 340/521 |
| 7,131,136 | B2 * | 10/2006 | Monroe | 340/945 |
| 2003/0048203 | A1 * | 3/2003 | Clary et al. | 340/945 |
| 2005/0200492 | A1 * | 9/2005 | Woodard et al. | 340/632 |
| 2006/0276943 | A1 * | 12/2006 | Anderson et al. | 340/945 |
| 2007/0012052 | A1 * | 1/2007 | Butler et al. | 62/181 |

OTHER PUBLICATIONS

"Technical Information for Carbon Monoxide Sensors". Technical Information for TGS2442. FIGAEO, an ISO9001 company. Mar. 2000.

* cited by examiner

C O Detector Installation Wiring Diagram

SECTION A–A

SECTION B–B

SECTION C—C

SECTION D - D

FWD

C O Detector Installation Wiring Diagram

Rs vs Altitude

| Altitude(ft) | Altitude(m) | Atmoshperic Pressure (mb) | Rs ratio |
|---|---|---|---|
| 0.00 | 0 | 1013.3 | 1.0000 |
| 3280.84 | 1000 | 898.7 | 0.9418 |
| 6561.68 | 2000 | 795.0 | 0.8858 |
| 9842.52 | 3000 | 701.1 | 0.8318 |
| 13123.36 | 4000 | 615.4 | 0.7799 |
| 16404.20 | 5000 | 540.2 | 0.7301 |
| 19685.04 | 6000 | 471.8 | 0.6824 |
| 22965.88 | 7000 | 410.6 | 0.6366 |
| 26246.72 | 8000 | 356.0 | 0.5927 |
| 29527.56 | 9000 | 307.4 | 0.5508 |
| 32808.40 | 10000 | 264.4 | 0.5108 |

Figure 10

Exhibit A
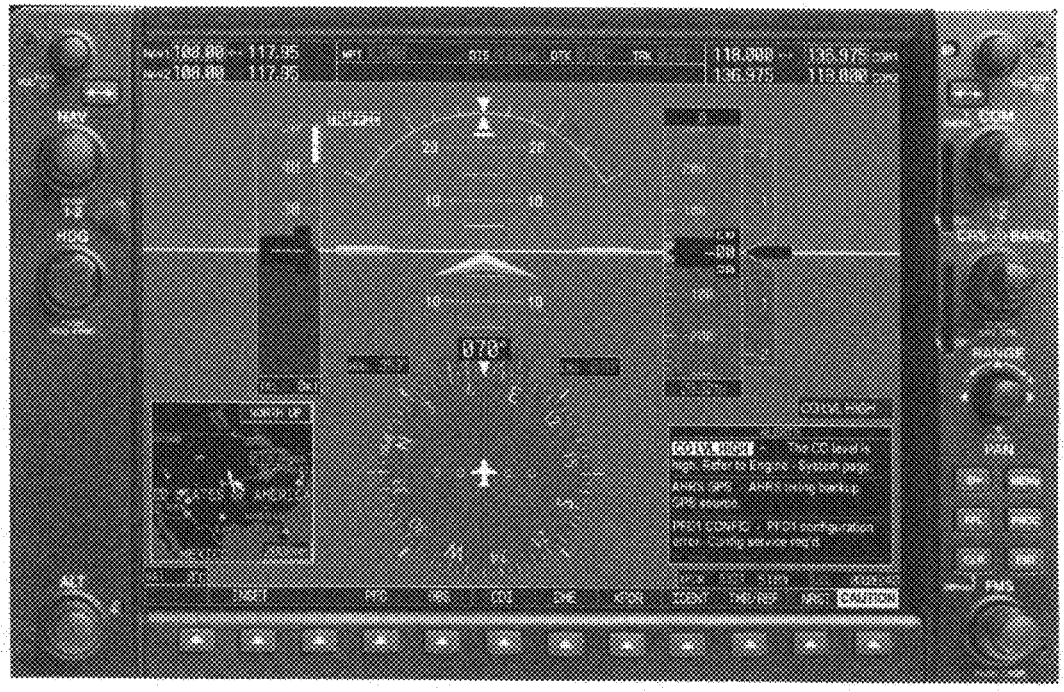

Exhibit B
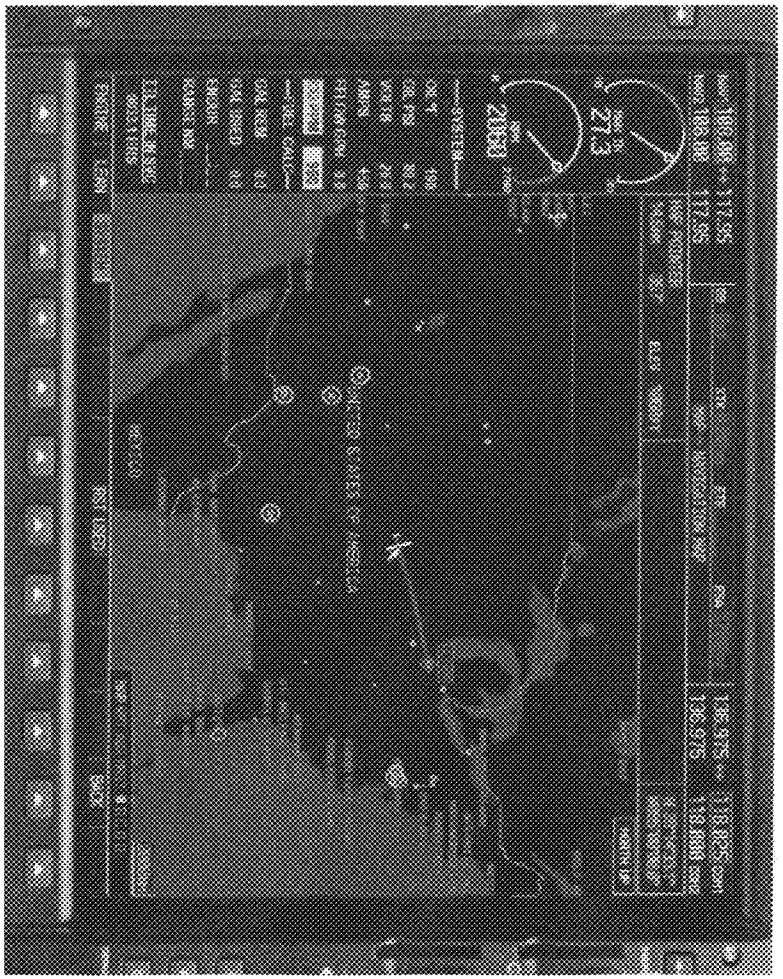

Exhibit C
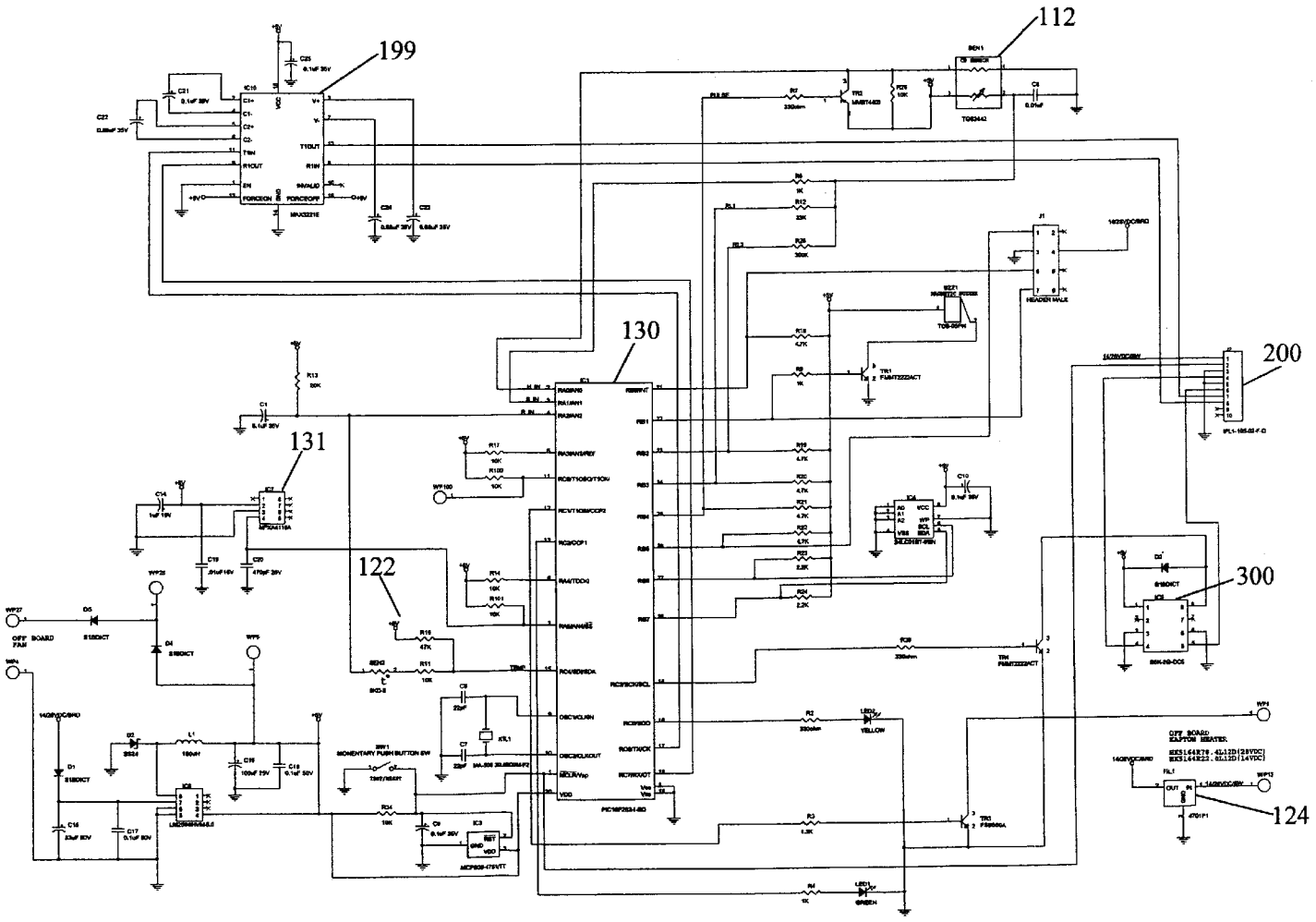

SENSING SYSTEM AND COMPONENTS FOR DETECTING AND REMOTELY MONITORING CARBON MONOXIDE IN A SPACE OF CONCERN

BACKGROUND

The present invention relates to a new and useful CO sensing system, and components of such a system, for detecting and remotely monitoring carbon monoxide (CO) in a space of concern.

Carbon monoxide (CO) is an odorless, tasteless gas that often results from incomplete combustion of fuel. Carbon monoxide can be particularly dangerous when accumulated in a space such as an aircraft cabin, a motor vehicle occupant compartment, a garage, an unventilated room or office, etc.

CO detectors are generally intended to identify when CO levels in a space of concern reach dangerous levels (e.g. 50 ppm). In applicant's experience, prior CO detectors are designed to emit visual and/or audio alarms that alert an occupant of the space that the CO level is dangerous. Such detectors are usually in the form of detection boxes that provide a visual alarm or audio signal to those in the vicinity of the detection box.

SUMMARY OF THE INVENTION

The present invention is designed to improve on such existing CO detection concepts. The present invention provides a CO sensing system that includes a CO detection device that detects CO levels in a space of concern, and communicates with a remote monitoring device, to provide the remote monitoring device with alert signal(s) when CO levels in the space of concern reach dangerous levels. The space of concern may be e.g. a location in vehicle cabin or occupant compartment, or it may be a space more proximate to the vehicle fuel processing system. The space of concern may be a garage, or it may be a home or business location.

According to one preferred embodiment, the CO detection device is designed for an aircraft. The remote monitoring device is the multifunctional display of the aircraft cockpit.

In addition, in a preferred embodiment, a reset/retest actuator is connected with the multifunctional display, and is in circuit communication with the CO detection device. The reset/retest actuator is selectively actuated from the multifunctional display to send a reset/retest signal to the CO detection device, to reset the CO detection device, and to initiate operation of the CO detection device to repeat its carbon monoxide detection process and provide a signal related to the level of carbon monoxide detected by the CO detection device.

Moreover, in a preferred embodiment, the CO detection device includes a carbon monoxide detection component, and a heating element that is proximate to the carbon monoxide detection component. The heating element is selectively actuated to heat the air space about the carbon monoxide detection component. Also, an adjustment device is provided, for adjusting the output of the CO detection device in relation to the air pressure in the selected space of concern. These features are particularly useful in a CO detection device for an aircraft, where ambient temperatures may drop to levels that can adversely affect the performance of the CO detection device, or where pressure changes in the aircraft may affect the sensitivity of the CO detection device.

Still further, in a preferred embodiment, the CO detection device is connected not only to the remote monitoring device (e.g. the multifunctional display of an aircraft), but also to one or more auxiliary devices that can provide useful functions in the event of detection of carbon monoxide above a predetermined level. The communications between the CO detection device, the remote monitoring device and the auxiliary device(s) is configured so that the remote display can provide a control signal that is communicated from the remote monitoring device to the CO detection device, to cause another signal to be communicated from the CO detection device to the auxiliary device to initiate the function of the auxiliary device.

Other features of the present invention will become further apparent from the following detailed description and the accompanying drawings.

BRIEF DESCRIPTION OF THE DRAWINGS AND EXHIBITS

Figures 2, 2A:
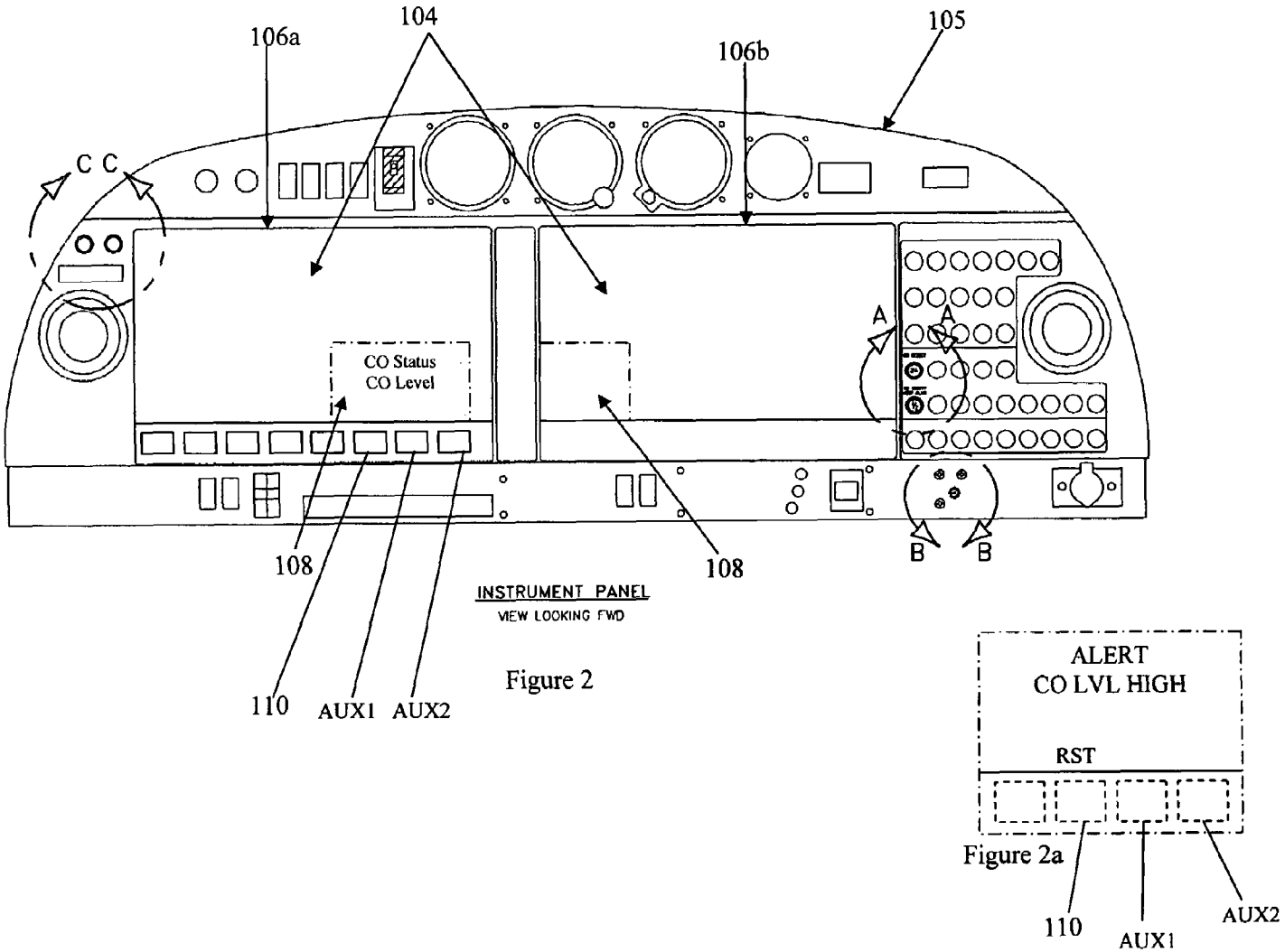
FIG. 2 is a schematic illustration of a multifunctional display of an aircraft cabin, that forms a part of a CO sensing system according to a preferred embodiment.
Figure 3:
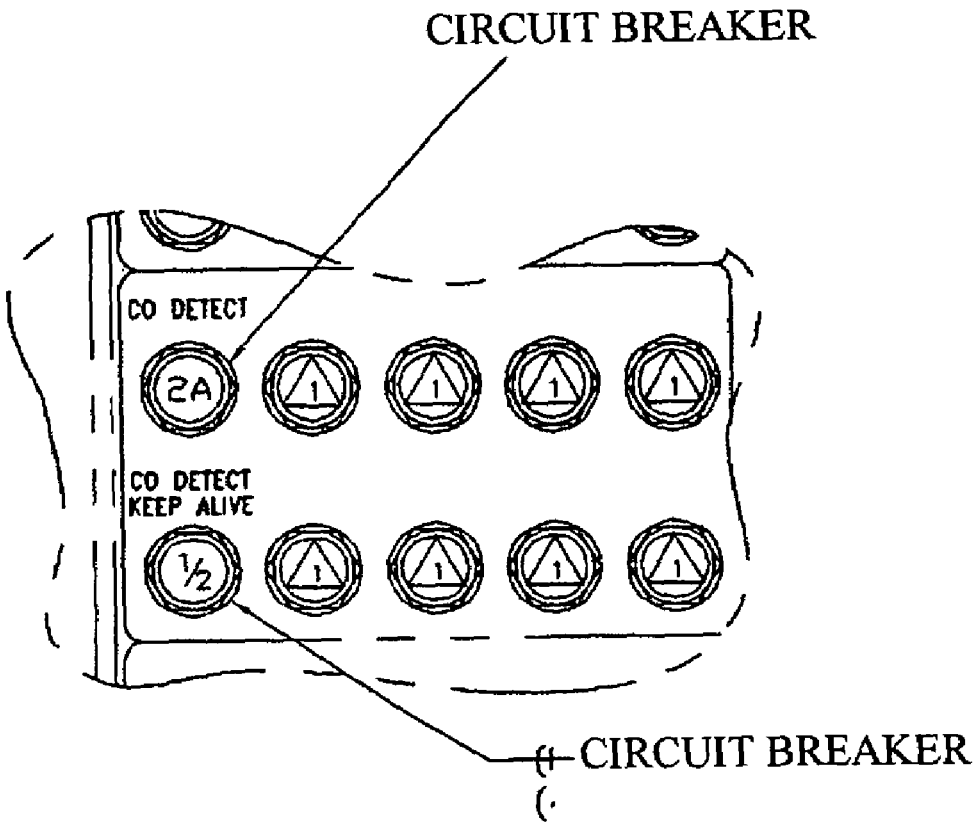
Figure 4:
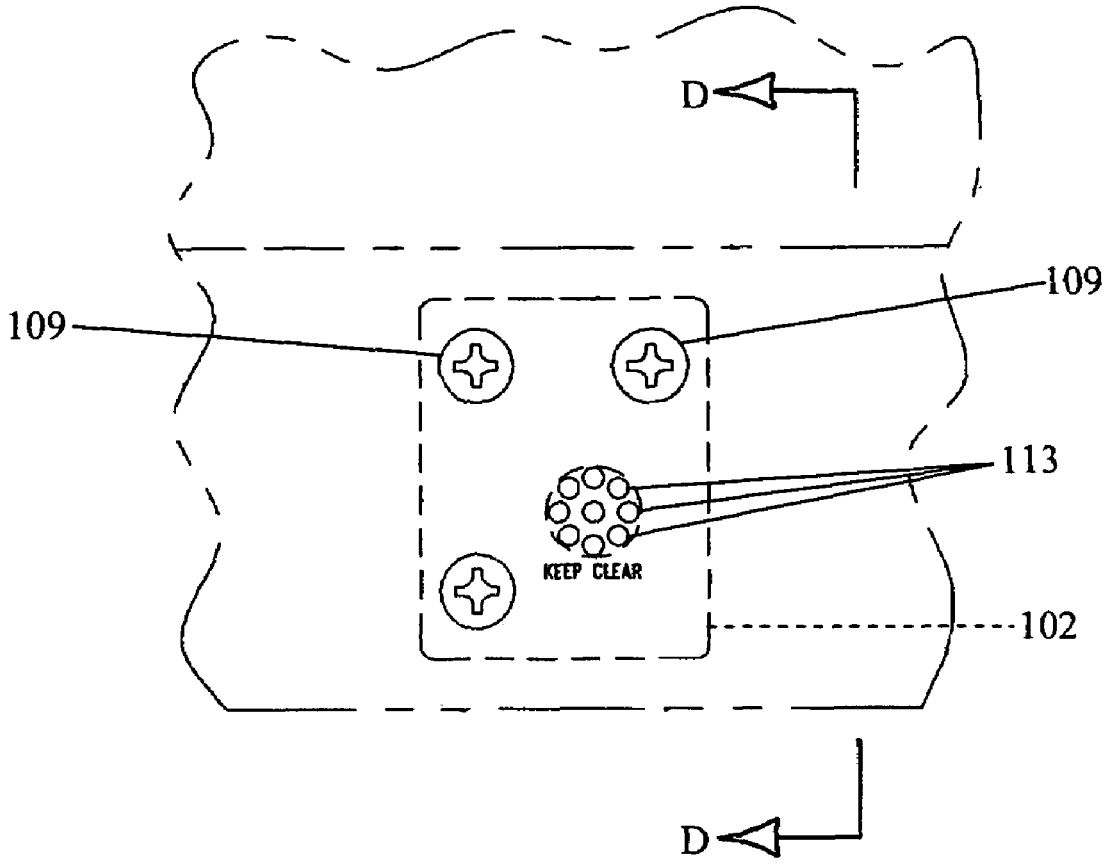
Figure 5:
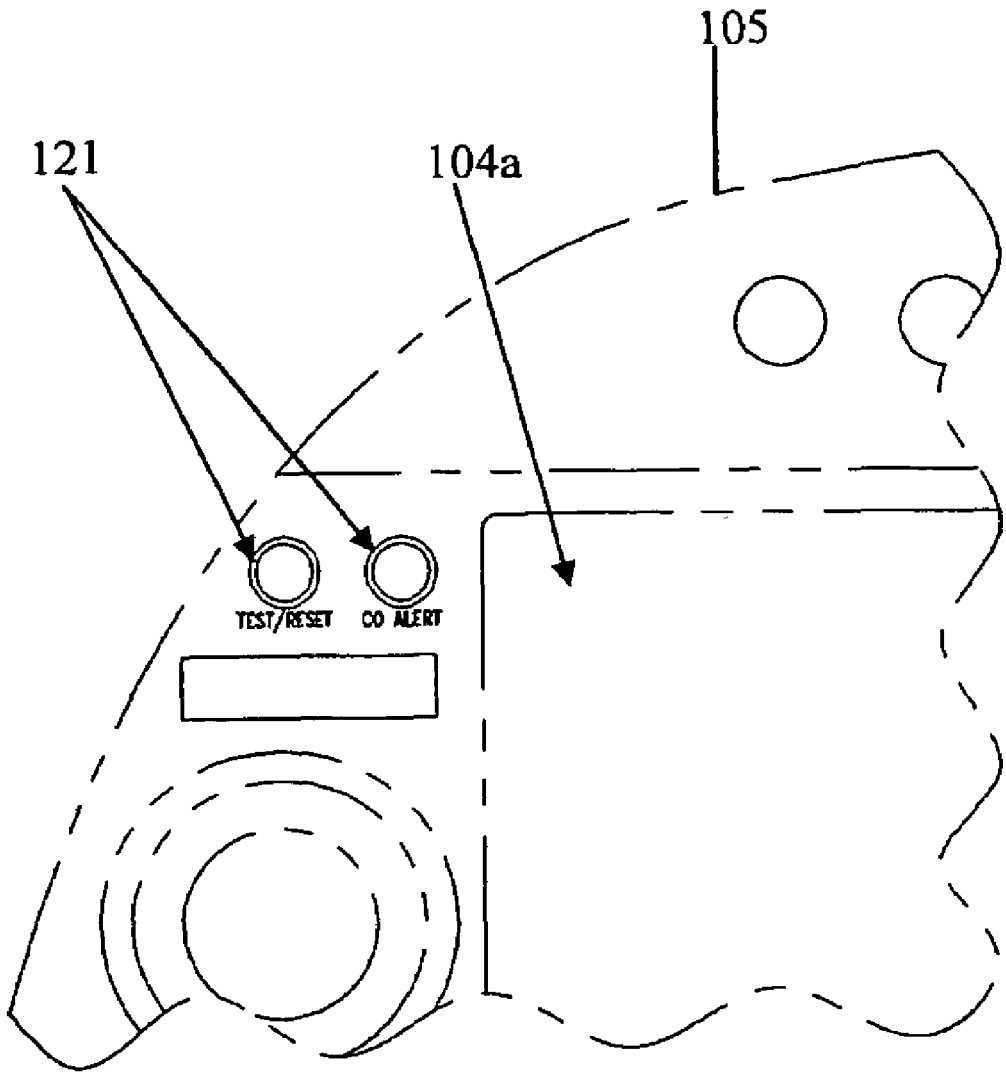
Figure 6:
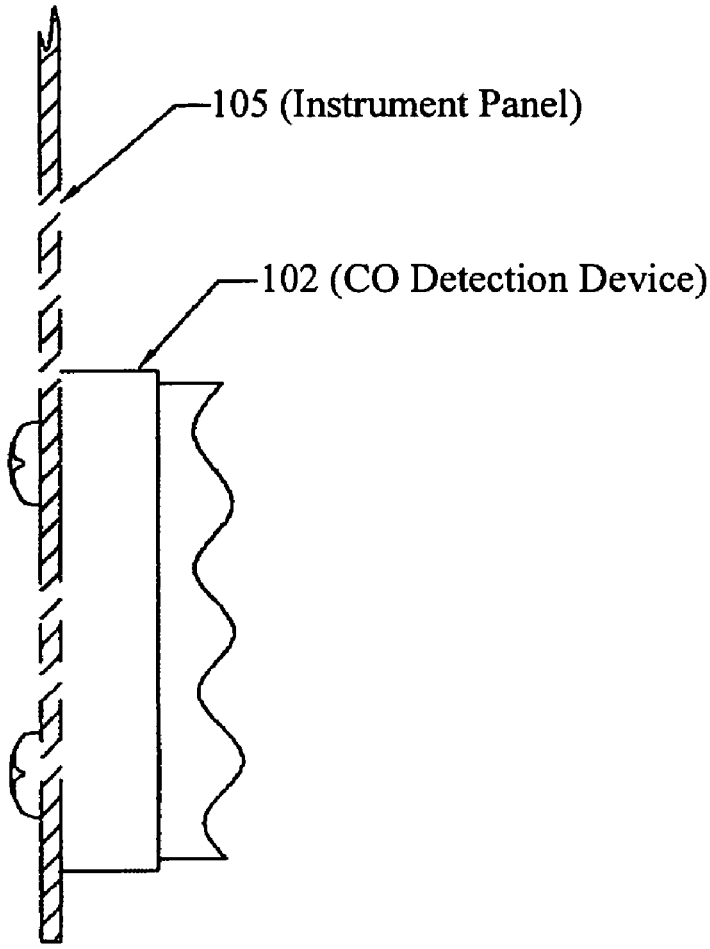
Figure 7:
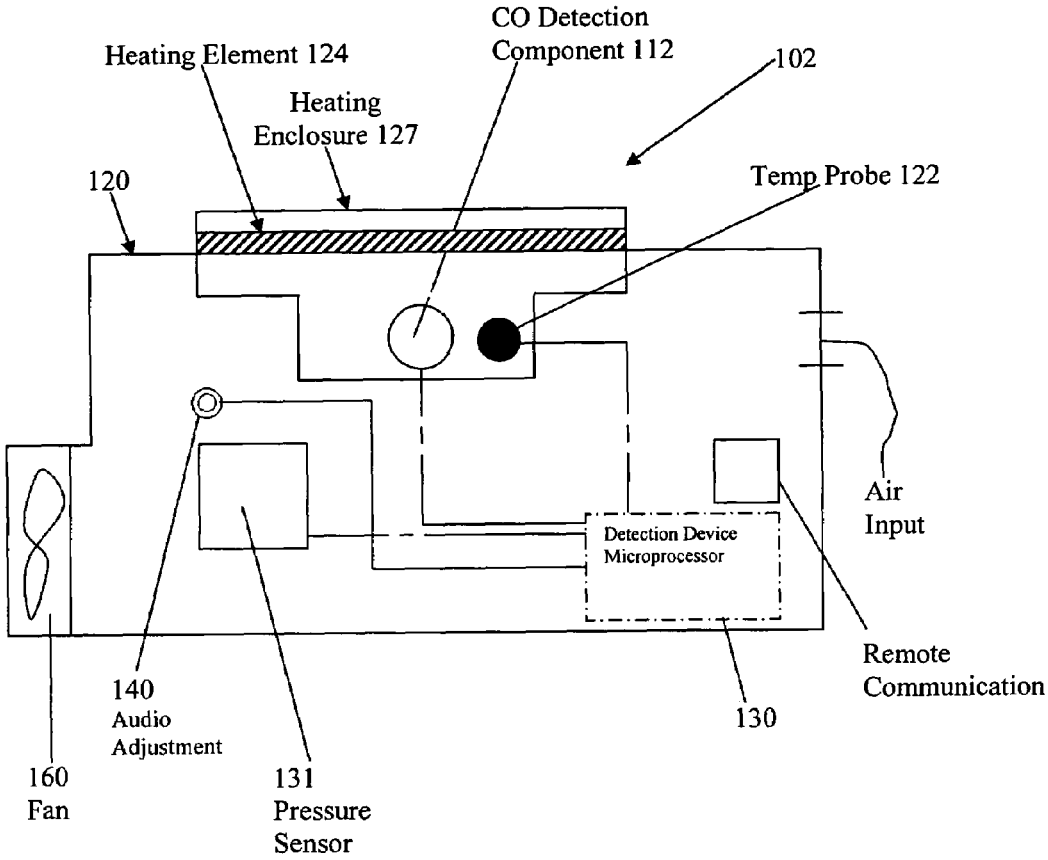
Figure 8A:
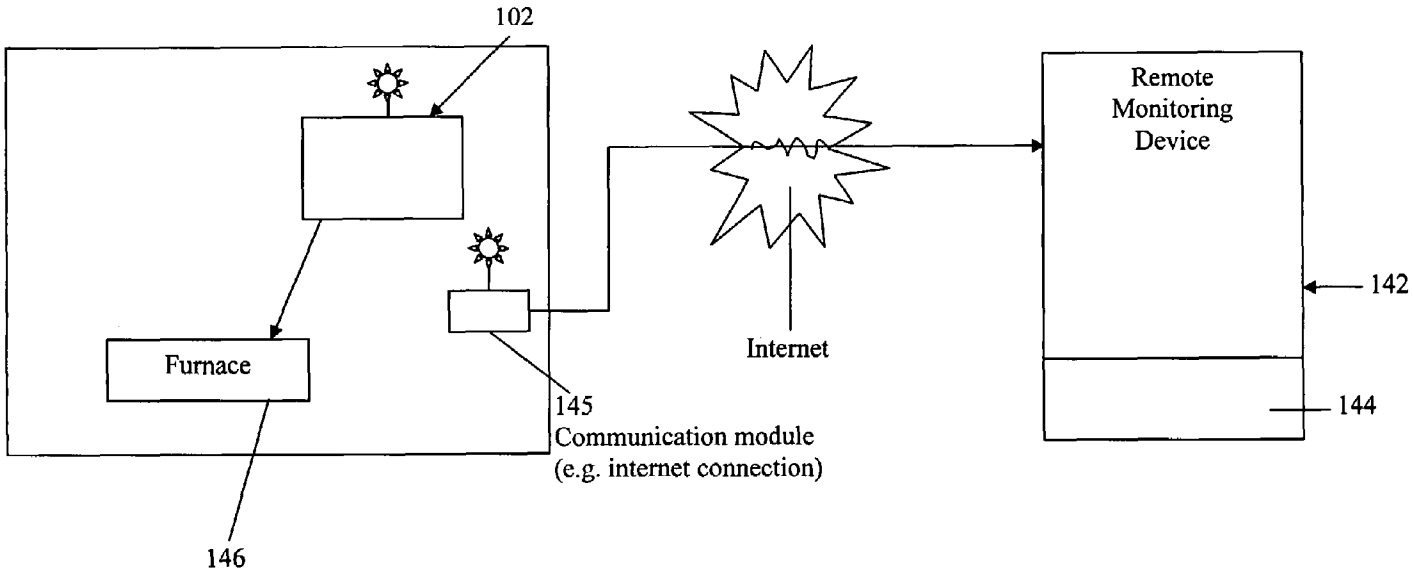
Figure 8B:
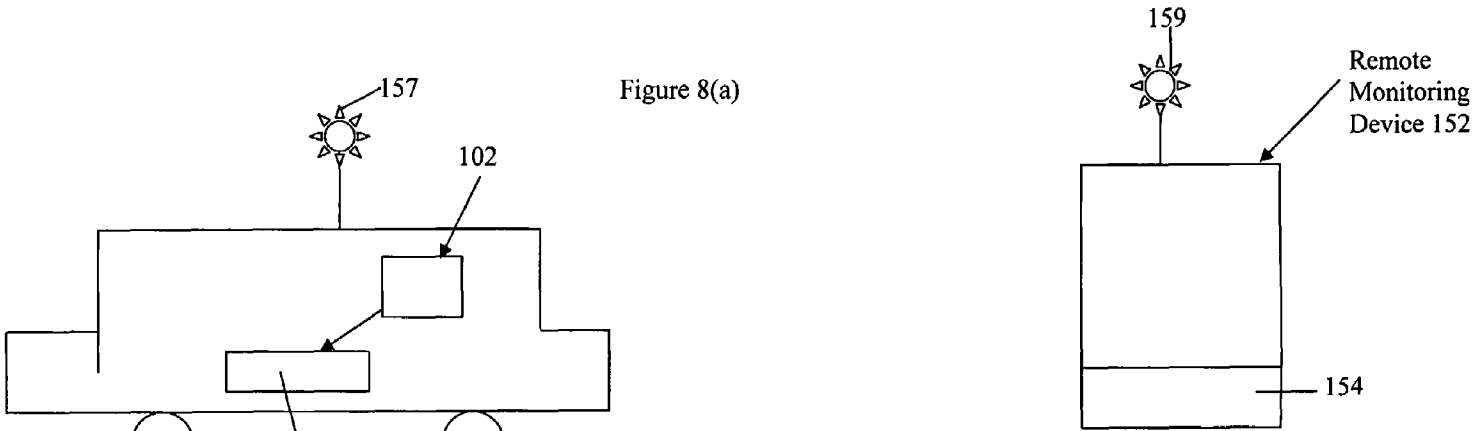
Figure 9:
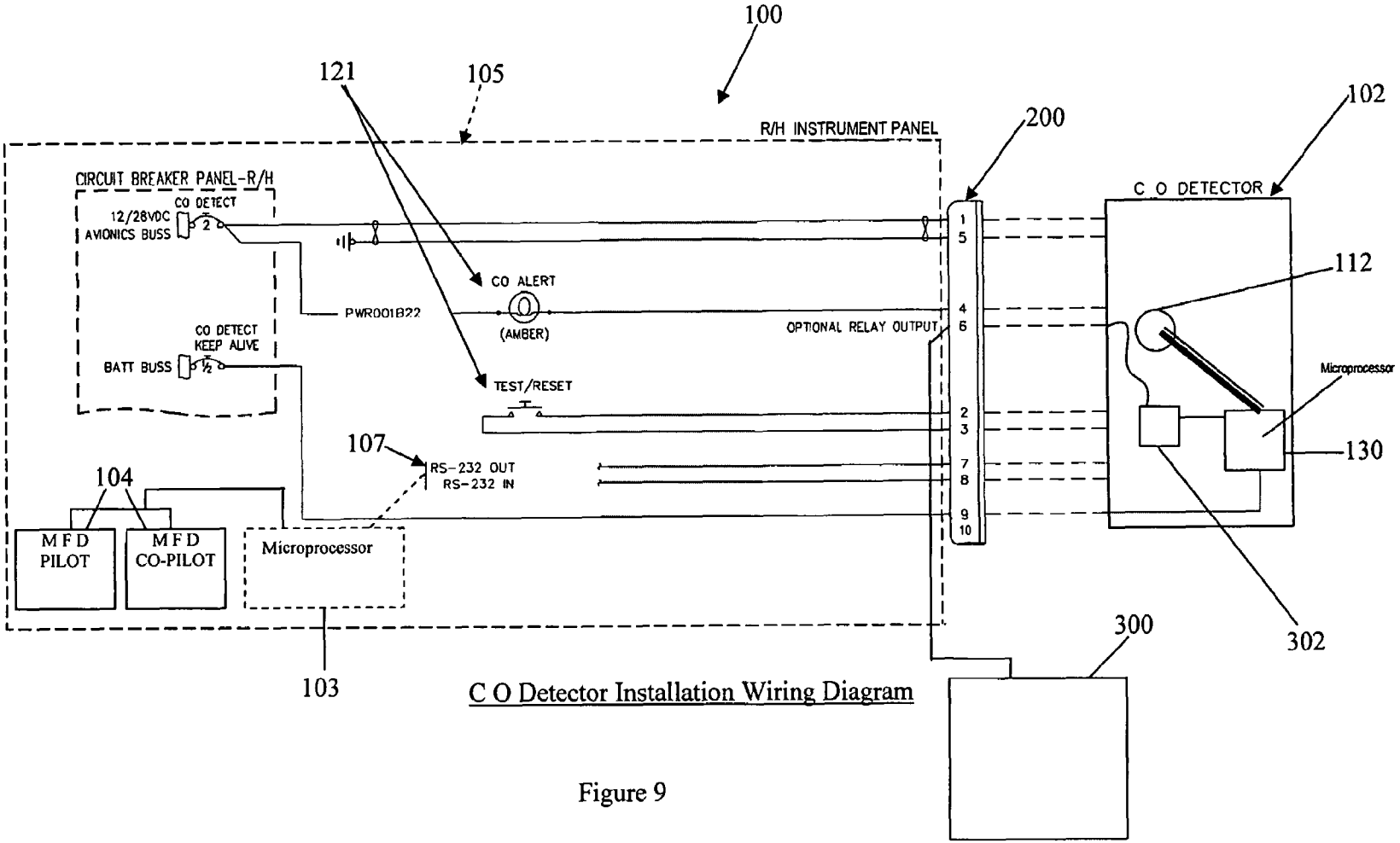

FIG. 2*a* is a fragmentary portion of the multifunctional display of FIG. 2, and specifically showing the visual display regarding CO status;

FIGS. 3-6 are sectional views of the multifunctional display, taken of the sections A-A, B-B, C-C, and D-D, respectively, as shown;

FIG. 7 is a schematic illustration of the components of a CO detection device, according to a preferred embodiment for use with an aircraft;

FIGS. 8*a* and 8*b* are schematic illustrations of the manner in which the principles of the present invention can be applied to a CO detection device for a home, business, or for an automobile such as a racing car, respectively; and FIG. 9 is a schematic illustration of the manner in which a CO detection device, a remote monitoring device and an auxiliary device can be configured to communicate with each other, according to the principles of the present invention.

FIG. 10 illustrates the calculations that are used to adjust the output of a CO detection component for an aircraft, to account for changes in pressure changes at higher altitudes, in accordance with the present invention.

Exhibits A and B illustrate glass cockpit multifunctional displays, for a CO detection system produced according to the principles of the present invention.

Exhibit C is a wiring diagram for the CO detection device of FIG. 8.

DETAILED DESCRIPTION

As discussed above, the present invention relates to a new and useful CO sensing system that is particularly useful in detecting and monitoring CO levels in a space of concern in an aircraft. The principles of the invention are described below primarily in connection with a CO sensing system for an aircraft, but from that description, the manner in which those principles can be applied to CO sensing systems for various applications will become apparent to those in the art.

Initially, it is believed useful to explain the importance of CO detection in an aircraft, and also the importance of remote communication of CO information to a remote monitoring device, according to the principles of the present invention.

Carbon monoxide (CO) is an odorless, tasteless gas that often results from incomplete combustion of fuel. Carbon monoxide can be particularly dangerous when accumulated in a space such as an aircraft cabin, a motor vehicle occupant compartment, a cabin or enclosed space in a vessel, a garage, an unventilated room or office, etc. Thus, if CO levels in an aircraft cabin reach dangerous levels, it is important for the aircraft operator to quickly understand that danger, so that appropriate action can be taken. Aircraft operators are normally particularly attentive to the multifunctional display of the aircraft (e.g. the so called "glass cockpit" for example) so they know the condition of the aircraft, and applicant believes that a CO sensing system that communicates CO levels remotely to the multifunctional display of the aircraft is particularly useful to the aircraft operator, since it communicates with the aircraft operator through a medium that normally has the operator's attention.

On the other hand, while in many instances a CO detection device can also be located in the aircraft cabin, applicant believes it may also be useful to locate the CO detection device in spaces of concern outside the cockpit, e.g. there may be locations close to the aircraft engine where CO detection is useful, particularly where CO accumulation in those spaces could be a precursor to CO accumulation in the cockpit. Thus, if CO accumulation in those spaces of concern can be detected, and communicated quickly, efficiently and remotely to the multifunctional display, that information can be particularly useful to an aircraft operator in addressing the problem before the CO accumulation actually occurs in the cockpit.

Figure 1:
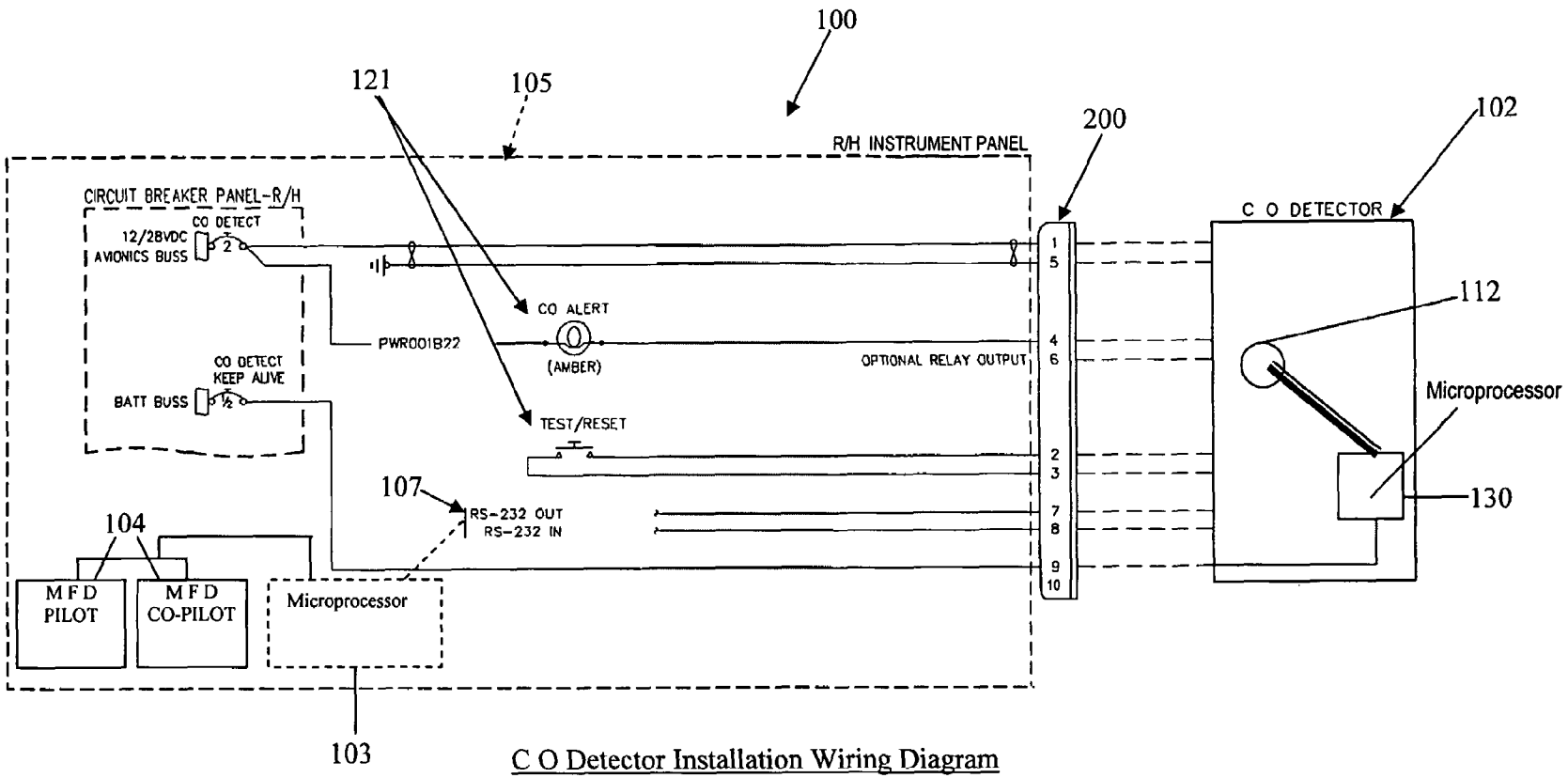
FIG. 1 is a schematic illustration of a CO sensing system, constructed according to the present invention.

The present invention, as exemplified by the CO sensing system 100 shown in FIGS. 1 and 9, and its components shown in FIGS. 2-7, Table 1 the multifunctional display examples of Exhibits A and B, and the wiring diagram of Exhibit C, is particularly designed to address those issues. The CO sensing system 100 comprises a CO detection device 102, a multifunctional display 104 (sometimes referred to as an MFD) that is remote from the CO detection device 102 and is in circuit communication with the CO detection device 102, so that there is communication between the CO detection device and the remote multifunctional display.

Definitions: In this Application, a. "circuit communication" means wired connection, wireless connection (by electromagnetic, satellite, over the internet, etc), or any other form of circuit by which electric, electromagnetic or electronic signals can be communicated from one component to another.

b. Moreover, one device being "remote" from another device means that the devices have separate housings such that communication between the devices requires circuit communication that extends between their respective housings.

c. In addition, the concept of "communications between" a CO detection device and a remote monitoring device is intended to encompass communication in which one or more microprocessors forming part of either or both devices are in circuit communication with the CO detection device (or its components) and/or the monitoring device.

d. Finally, reference to a CO detection device being in circuit communication with a remote monitoring device also means that whatever is between CO detection device and remote monitoring device has as its primary function to establish and maintain (for as long as necessary) communication between the CO detection device and the remote monitoring device (as opposed to providing its own distinct functionality to a system). Thus, the concept of a CO detection device being in circuit communication with a remote monitoring device is intended to exclude a device like the base station of U.S. Pat. No. 6,930,599 that provides primary functionality to signals it receives from a sensor and from a camera, and then communicates with other system components such as a central station.

In the example of FIGS. 1-7, 9, 10, and Exhibits A-C, the CO detection device 102 is remote from the multifunctional display 104 and is in circuit communication with the microprocessor 103 of the multifunctional display. In the example of FIGS. 1-7, the CO detection device 102 is on one side of an instrument panel 105 that includes the multifunctional display 104. The CO detection device 102 is in circuit communication with the microprocessor 103 of the multifunctional display, by means of an RS 232 communication cable and protocol (In Exhibit C the RS 232 generator or driver circuitry is shown at 199). Also, the CO detection device 102 can be located in the aircraft cabin itself, or may be located on the backside of the instrument panel, which is outside the aircraft cabin, but more proximate to the aircraft engine. Thus, the CO detection device 102 is close enough to the aircraft cabin that CO accumulation in the space on the backside of the instrument panel represents a threat to the cabin, and therefore a concern to the operator of the aircraft. In the illustrated example, the CO detection device 102 is located on the backside of the instrument panel 105. The CO detection device is therefore more directly exposed to the atmosphere about the aircraft engine, and can detect levels of CO in that atmosphere before CO accumulation reaches the aircraft cabin.

According to the present invention, the CO detection device 102 continuously monitors CO levels in the space of concern, particularly to detect CO levels (e.g. 50 ppm) that represent a danger to the cabin, and communicates information regarding CO levels in the space of concern remotely to the multifunctional display 104.

In the illustrated example, the multifunctional display 104 would be of the "glass cockpit" type, with a display 106 that is designed by the avionics designer for that aircraft. In the illustrated example, the multifunctional display comprises a screen display that includes a pilot display 106*a* that is proximate the aircraft pilot, and a co-pilot display 106*b* that is proximate the aircraft co-pilot. The multifunctional display 104 would also include screen portions 108 (on either or both of the pilot and co-pilot displays 106*a*, 106*b*) that provide a visual indication of the CO level detected by the CO detection device 102, and provide a visual alert when CO is detected at predetermined levels (e.g. 50 ppm). Exhibits A and B show examples of the visual alerts that would be provided at the screen components. The screen portion 108 on the pilot side may provide, e.g, an alert visual (see FIG. 2*a* and Exhibit A) and the screen portion 108 on the co-pilot side may provide a visual of the CO level detected by the CO detection device (see Exhibit B). In addition, a "retest/reset" actuator 110 is associated with the multifunctional display 104. The retest/reset actuator 10 is preferably a button (or a pair of buttons) provided on a structural portion of the multifunction display, and in relation to the portion of the multifunctional screen portions 108 that provide the visual indication of a CO alert or the CO level detected, and shows the pilot (or co-pilot) the location of the retest/reset actuator(s) 110. A retest/reset actuator 110 is used to reset the CO detection device, and initiate a retest of CO levels by the CO detection device 102, in accordance with the principles of the present invention.

The overall operation of a CO sensing system, according to the principles of the present invention, can be appreciated by reference to FIGS. 1-7, 10 and Exhibits A, B, and C. The CO detection device 102 is designed to sense CO levels in a space of concern. In the example of FIGS. 1-7, the CO detection device 102 includes a CO detection component 112 that is located in a housing 120. The housing 120 is secured to the backside 114 of the instrument panel 105 that includes the multifunction display 104. The CO detection device 102, including detection component 112 is exposed to the atmosphere proximate the aircraft engine. The CO detection device 102 is remote from the part of the multifunctional display where the CO screen display portion(s) 108 are located, and is in circuit communication with the microprocessor 103 of the multifunctional display. More specifically, the CO detection device includes an input/out device 200 through which the CO detection device can communicate with the multifunctional display and with other components of the system that are external to the CO detection device 102.

The CO detection device 102 continuously samples the atmosphere in its vicinity, and continuously communicates with the microprocessor 103 of the multifunctional display 104. As an example, the CO detection device 102 may be configured so that the detection component 112 samples the atmosphere once a second, which for purposes of this application, effectively provides continuous sampling of the atmosphere. The CO screen display 108 can comprise e.g. a visual image 114 that is produced in the multifunctional display 104 (e.g. either of both of the pilot and/or co-pilot displays 104*a*, 104*b*), under the control of microprocessor 103, based on the CO levels detected by the CO detection device 102. The visual image can be an image that indicates that CO levels are at acceptable levels, while CO levels are below a threshold. Moreover, that visual image can produce an alert message (e.g. a message in a color and/or format that will get the aircraft operator's attention) when CO levels detected by the CO detection device 102 are at levels of concern (e.g. 50 ppm), as shown by Exhibits A and B. The visual image preferably also shows the CO level detected by the CO detector (see Exhibit B). An audio alarm can also be associated with the CO detection device 102, so that when the alert message is presented to indicate a dangerous condition, the audio alarm is also triggered to provide an additional way to get the operator's attention to the CO level. In addition, the alert message can be accompanied by an instruction to the operator (e.g. via the screen display portions 108) as to what action the operator should take, to respond to the alert message. As an example, Exhibit A shows a pilot's screen display and Exhibit B shows a co-pilot's screen display during a CO alert situation. The pilot's screen display portion 108 highlights the alert condition to the pilot (FIG. 2*a*, Exhibit A), and the co-pilot's screen display portion 108 shows the CO level detected by the detection device that triggered the alert message (Exhibit B). Either screen display portion 108 can also provide an instruction to the pilot or co-pilot to press a "retest/reset" button 110, to initiate a reset and retest of the CO detection device.

If the CO screen display portions 108 on the multifunctional display present an alert message, the operator(s) (pilot and co-pilot) whose attention would normally be on the multifunctional display, should be immediately alerted to a condition of concern, and can take appropriate actions, to minimize the risk of CO poisoning. In addition, the retest/reset actuator 110 enables the operator who notices the alert, to immediately initiate from the multifunctional display a reset and retest by the CO detection device, to confirm whether CO levels are at alarm state. In the example of Exhibits A, B, the retest/reset button 110 is a manually operated switch such as the switch labeled RST on the co-pilot's screen display portion (FIG. 2*a*, Exhibit A). (Moreover, the switch can also be a "touch screen" portion of the multifunctional display 104, but in an aircraft that is generally not preferred, since a touch screen switch may not be as reliable as a simple button switch). By pressing the retest/reset actuator button 110 associated with the multifunctional screen display, the CO detection device 102 is initially reset, and then begins again to continuously sense CO levels in its proximity and communicates those levels with the microprocessor 103 that controls CO screen display portions 108 of the multifunctional display 104. The retest may show a more acceptable CO condition, or may confirm the alert condition. This ability to retest/reset remotely gives the aircraft operator an opportunity to reset and resample the atmosphere about the CO detection device, before concluding as to whether the CO levels in the space of concern are a threat to the aircraft cockpit.

FIG. 1 shows a wiring diagram for a CO sensing system according to the present invention. The CO detection device 102 is in circuit communication with the microprocessor 103 of the multifunctional display of the aircraft through an RS 232 serial port 107. The RS 232 serial port can include, e.g., a 9 pin or 25 pin cable connection, each of which would have an RS 232 "out" pin for continuously sending a CO detection signal to the microprocessor 103, under the control of the microprocessor 130 and clock of the CO detection device 102. The RS 232 port would also include an RS 232 "in" pin for sending a signal to the CO detection device for resetting the detection device, and requesting a CO detection signal, as described further below. The RS 232 "in" pin can also be used to enable an instruction to be selectively sent to the CO detection device to cause the CO detection device to send a signal to an auxiliary device, to initiate an operation of that auxiliary device, as described further below in connection with FIG. 9. The input/output 200 of the CO detection device 102 is configured to receive and transmit signals via the RS 232 serial port 107. The generator or driver circuit for the RS 232 communication protocol is shown at 199 in Exhibit C.

The CO detection device 102 is normally operated by an internal microprocessor 130 (FIG. 7, Exhibit C) with an internal clock that causes a CO signal to be sent to the multifunctional display at sampling internals of 3 CO samples every second, which, as described above, essentially provides continuous sampling of CO levels. The microprocessor 130 can be e.g. PIC 18E252-I/SO microprocessor, made by Microchip Technology Inc., 2355 West Chandler Blvd., Chandler, Ariz., USA 85224-6199

The CO signal sent to the microprocessor 103 of the multifunctional display is in the form of a voltage signal that is related to the CO level detected. The voltage signal is processed by the microprocessor 103 associated with the multifunctional display 104, to provide a message at CO indicator screen display portion(s) 108 that is related to the level of CO detected. Moreover, the nature of the message that is presented to the operator (e.g. via the visual image on a CO screen display portion 108) is based on that level of detected CO, and the settings that are predetermined for the sensing device regarding what level of CO detection will trigger an alert message. When a CO level is communicated to the microprocessor 103 to trigger an alert signal at the multifunctional display 104, the operator may want to initiate a reset and retest of the CO level, to verify to the operator that the cockpit cabin is properly at a CO alert state. The operator can initiate a reset/retest process; by pressing the retest/reset button 110 associated with the multifunctional display, to send a signal to the CO detection device 102 over the RS 232 "in" line. That signal resets the CO detection device, and causes the CO detection device to again begin sampling the CO in its vicinity and sending CO level signals to the multifunctional display over the RS 232 "out" line, under the control of the detection device processor 130 and internal clock.

In the wiring diagram shown in FIG. 1, and the instrument panel display of FIG. 2, there are switches 121 labeled "CO Alert" and "Test/Reset" that are different from the RS 232 cable connectors described above. Those switches are also found on the instrument panel 105 that includes the multifunctional display. Those "CO Alert" and "Test/Reset" switches are in circuit communication with the CO detection device 102, through the input/output device 200 and by communications other than an RS 232 cable, and provide the system with an alternative way to provide a CO alert signal to the cockpit, and an alternative way to initiate a reset/retest of the CO detection device. Also, the circuitry of FIG. 1 includes circuit breaker circuitry 125 to protect against power overload.

Still further, as shown by the wiring diagram of FIG. 1, the preferred embodiment of the present invention, as applied to an aircraft CO sensing device, includes circuitry to maintain electrical power to the CO detection device 102, even when the aircraft engine has been shut down, so that the CO detection device 102 stays electrically alive (i.e. ready to operate) even when the aircraft engine has been shut down. The aircraft has an electrical power source such as a battery 123, and the battery is electrically coupled to the CO detection device 102 (i.e. through the input/output 200 and to the microprocessor 130 that controls the operations of the CO detection device), even when the aircraft engine has been shut down. Thus, even if the aircraft is not used for a significant period, when the aircraft is used, the CO detector 102 is essentially in an active ("stay alive") condition, and thus does not require the time (and possibly the recalibration or reinitialization) that would normally be required to make the CO detection device 102 operate in the manner intended.

A CO detection component 112 that can be used in a sensing device 102 according to the present invention can be of a type manufactured and distributed by Figaro Engineering. The structure and operating principles of such a CO detection component can be according to the Figaro Model TGS 2442 sensor- for the detection of Carbon Monoxide. According to Figaro on line literature, the TGS 2442 utilizes a multilayer sensor structure. A glass layer for thermal insulation is printed between a ruthenium oxide (RuO2) heater and an alumina substrate. A pair of Au electrodes for the heater are formed on a thermal insulator. A gas sensing layer, which is formed of tin dioxide (SnO2), is printed on an electrical insulation layer which covers the heater. A pair of Au electrodes for measuring sensor resistance are formed on the electrical insulator. Activated charcoal is filled between the internal cover and the outer cover for the purpose of reducing the influence of noise gases. In the presence of CO, the sensor's conductivity increases depending on the gas concentration in the air. A simple pulsed electrical circuit operating on a one second circuit voltage cycle can convert the change in conductivity to an output signal which corresponds to gas concentration. The output signal is typically an output voltage.

The operating principles of the TGS 2442 detection component are also described in the Figaro on line literature. According to the literature, the sensing material in TGS gas sensors is metal oxide, most typically SnO2. When a metal oxide crystal such as SnO2 is heated at a certain high temperature in air, oxygen is adsorbed on the crystal surface with a negative charge. Then donor electrons in the crystal surface are transferred to the adsorbed oxygen, resulting in leaving positive charges in a space charge layer. Thus, surface potential is formed to serve as a potential barrier against electron flow. Inside the sensor, electric current flows through the conjunction parts (grain boundary) of SnO2 micro crystals. At grain boundaries, adsorbed oxygen forms a potential barrier which prevents carriers from moving freely. The electrical resistance of the sensor is attributed to this potential barrier. In the presence of a deoxidizing gas, the surface density of the negatively charged oxygen decreases, so the barrier height in the grain boundary is reduced. The reduced barrier height decreases sensor resistance, and enables output voltage to change as a function of the CO concentration that causes the decrease in sensor resistance.

Still further, from the on line Figaro literature, it is known that there is a relationship between oxygen pressure in the atmosphere (PO2) and the resistance of a typical TGS sensor in clean air. The relationship of sensor resistance to gas concentration is linear on a logarithmic scale within a practical range of gas concentration.

According to the preferred embodiment, the CO detection device 102 of the present invention is also configured to sense the air temperature about the CO detection component 112, and is also configured to heat the air proximate the CO detection component if the air temperature drops below a predetermined threshold. The threshold would normally be set at a temperature at which performance of the CO detection component 112 might degrade, and since temperature in an aircraft can easily drop with increasing altitude, heating the air about the CO detection component at a predetermined threshold is particularly useful in an aircraft.

In the illustrated example, and as schematically shown in FIG. 8, the CO detection device 102 includes the detection component 112 located in a heating enclosure 127 connected with the housing 120. A temperature probe 122 is located inside the heating enclosure 127, and a heating element 124 is provided within the heating enclosure 127, and proximate to the detection component 112. Thus, when the temperature probe 122 senses a temperature at a predetermined threshold (e.g. related to a temperature at which the performance of the CO detection component would be adversely affected), the heating element 124 will be turned on, to heat the space within the heating enclosure 127 and about the CO detection component 112, so that the CO detection device's performance will be maintained.

Additionally, the present invention is also designed to account for sensitivity changes in the CO detection component that may occur at predetermined pressure changes. Air pressure can change in an aircraft, in relation to the altitude of the aircraft. At higher altitudes, air pressure typically decreases. As the air pressure decreases, the sensitivity of the CO detection component may change. The present invention adjusts the output of the CO detection device 102 in a manner related to that change in sensitivity, to produce at the multifunctional display an output that is more consistent with the CO condition of the space of concern. More specifically and as schematically shown in FIG. 7, a fan 160 establishes a flow of air through the CO detection device, and a pressure sensor 131 is in circuit communication with the internal microprocessor 130 of the detection device 102. The microprocessor 130 is configured such that when air pressure reaches a point that would change the sensitivity of the detection component 112, the microprocessor 130 makes an appropriate adjustment of the signal that is output to the multifunctional display, so that the signal communicated to the multifunctional display is adjusted to more accurately represent the CO level that may affect the cockpit. FIG. 10 shows an example of the multipliers (Rs ratio) that are used to adjust the output of the detection component, to account for changes in air pressure about the detection device. Specifically, as the altitude of the aircraft increases, the atmospheric pressure decreases, and the resistance of the CO detection component increases. Without an adjustment, there could be inaccuracy in the CO level reported by the detection component. According to the present invention, the absolute value (e.g. of the voltage) that would normally be output from the detection component, is multiplied by the Rs ratio that corresponds to the altitude change, to adjust the output of the detection component to account for that altitude change. The microprocessor 130 forming part of the CO detection device is connected to an altitude sensor, of conventional design, so that the altitude changes are sent to the microprocessor, and the microprocessor is configured to perform that adjustment.

Still further, while the foregoing description relates to a CO sensing device for an aircraft, the principles of the present invention can also be applied to CO sensing systems for other applications. FIG. 8*a* schematically illustrates the basic structure of a CO sensing system for a home or office and FIG. 8*b* schematically illustrates a CO sensing system for a vehicle such as a racing car. For example, as shown in FIG. 8*a*, a CO detection device 102, can be located in a space of concern such as a garage or some other location in a home. The space of concern can also be a part of a business establishment. In such circumstances, the CO detection device 102 would be essentially the same type of device described above for an aircraft, but the sensitivity of the CO detection device might be different, depending on what levels of CO would be considered of concern in the particular environment in which the CO detector is located. Also, if altitude and/or temperature variations are not as likely to affect the output of the detection device, they may not be needed in the detection device. The remote monitoring device 142 could be located at a central monitoring station for a number of homes or establishments, or it could be in a desired location in the home or business establishment. The alert message presented at the remote monitoring device would be designed for the particularly environment in which the sensing device is operating (e.g. it could alert a remote monitoring company as to an alert condition in a home or business being monitored by the monitoring company, or it could alert the home or business occupant of an alert condition). Also, the CO levels (e.g. 100 ppm) could be displayed at the remote monitoring device 142, to enable verification at the remote monitoring device that the CO alert condition is real. In the system of FIG. 8*a*, circuit communication between the CO detection device 102 and the remote monitoring device 142 (and its microprocessor 144) would be established, e.g., via a communication module 145 (e.g. an internet wireless modem) that is configured to communicate locally with the CO detection device 102 and across the internet with the remote monitoring device 142.

Also, as shown in FIG. 8*b*, of the principles of the present invention can be applied to a sensing system for a vehicle such as racing car. The CO detection device 102 would be similar to that shown and described in FIG. 7 and Exhibit C, and would be located on board a racing car, and a remote monitoring device 152 can be located, e.g. in the pit crew station for the racing car. The remote monitoring device 152 (and its microprocessor 154) can be in circuit communication with the CO detection device 102, via a wireless communication 156 that is preferably also a multipurpose module that can also communicate operating parameters of the racing car such as oil pressure, oil temperature, battery voltage, etc. In the case of a racing car, the output of the CO detection device can be in the form of a change in voltage output that is communicated (e.g. wirelessly from the communication module 156 via an antenna 157) to the remote monitoring device (via an antenna 159) that is accessible to a pit crew, and the remote monitoring device 152 can respond to that change in output voltage to alert the pit crew of an alert condition in the racing car occupant compartment.

In addition, the principles of the present invention can be applied to a CO sensing system for a passenger or commercial vehicle with an occupant cabin. For example, a CO detection device can sense CO levels caused by the vehicle engine, or by a neighboring vehicle (e.g. a vehicle in front of the vehicle with the CO sensing device could be emitting CO from its exhaust that can cause the CO levels in the following vehicle to reach levels of concern). If the following vehicle has a CO sensing system of the type provided by the present invention, the vehicle dashboard can have a display that is similar to the multifunctional display of an aircraft cockpit, in the sense that it displays to the vehicle operator certain operating parameters of the vehicle. If CO levels are part of those operating parameters, CO can be detected in a space of concern (e.g. in the engine space of the vehicle) and when those CO levels reach predetermined thresholds, the display of the vehicle can provide an alert message to the vehicle operator. Moreover, it is contemplated that with a vehicle such as a passenger vehicle, if an alert message is sounded, that message can be accompanied by visual instructions to the vehicle operator as to steps to take to remedy the condition (e.g. open all vehicle windows). In addition, the CO sensing system, with the auxiliary device control features described below in connection with FIG. 10, can be used to initiate appropriate operations of auxiliary device(s) based on the detected CO levels. For example, when a CO alert condition is sensed, CO sensing system can be operated to shift the vehicle's air circulation system to a recirculating mode, to minimize admission of the CO containing air from the other vehicle, during a CO alert condition when the vehicle is idling, and to roll down all windows when vehicle begins moving. In a home or business monitoring system such as shown in FIG. 8*a*, the auxiliary device could be, e.g., the control for a furnace 146 (or vent fan) that needs to be turned off or on (as the case may be) to seek to reduce the CO level in the space of concern.

FIG. 9 schematically illustrates how the sensing device of the present invention can be further configured to enable the remote monitoring device to control an auxiliary device 300 that performs a useful function in connection with the detection device. With an aircraft CO sensing device, the auxiliary device 300 could be, e.g. a control device that can be remotely actuated to fresh vents to the aircraft cabin if the CO level becomes too high, to seek to reduce the CO level in the cockpit. With a home sensing device, the auxiliary device could be, e.g. a switch for a furnace that should be turned off if it is creating a CO level that is harmful to the home. The auxiliary device 300 could also be any other device that can perform a useful function when a CO level above a threshold is detected.

In the system of FIG. 9, the CO detection device 102 is connected not only to the remote monitoring device (e.g. the multifunctional display 104), but also to the auxiliary device 300 that can provide a useful function in the event of detection of carbon monoxide above a predetermined level. In FIG. 9, a control signal at the RS 232 "in" port, can be selectively initiated by an auxiliary switch (labeled AUX1 and AUX2 on the MFD) that is accessible to the operator of the CO sensing device (e.g. it is accessible to the aircraft pilot or co-pilot). Thus, one of the auxiliary switches AUX1, AUX2 can be actuated at the MFD of the aircraft cockpit, to send a signal to the CO detector 102 to initiate operation of an auxiliary device 300. The CO detector 102 electrical coupling includes an auxiliary relay 302 that communicates with the auxiliary switches, and the input/output 200 of the CO detection device 102 includes one or more ports (e.g. "6") that is in communication with the auxiliary device 300. Thus, when a pilot in the cockpit wants to send a signal to the auxiliary device 300, a signal can be selectively sent from the MFD 104 to the detection device 102 via the RS 232 cable, and that signal is processed by the microprocessor 130 and the relay 302, and will cause another signal to be sent from the CO detection device 102 to the auxiliary device 300. In a remote sensing system for a home, the auxiliary device 300 might be a switch to turn off a furnace that is causing the CO problem, and that signal can be communicated from the remote monitoring device to the switch through the auxiliary relay 302 of the detection device 102. Thus, as illustrated by FIG. 9, the communications between the detection device 102, the remote monitoring device and the auxiliary device(s) 300 is configured so that the remote monitoring device can selectively provide a control signal that is communicated through the detection device 102 and to the auxiliary device 300 to initiate the function of the auxiliary device 300.

As should be clear from the foregoing description, according to the present invention, reference to a CO detection device means a device that is designed to provide the functionality described herein in connection with CO detection device102, namely to provide a primary function of detecting CO levels in a space of concern, provide an output related to the detected CO levels in the space of concern, receive a reset/retest signal and reset itself and initiate a retest of the CO levels in the space of concern.

Moreover, the CO detection device also provides the additional capability of receiving a signal for initiating an auxiliary function and transmitting a signal to an auxiliary device for initiating that auxiliary function. In addition, the CO detection device may have the capability to sense temperature about a detection component and heat the space about the detection component, to modify the output based on altitude, and maintain the CO detection component in a ready state even when an aircraft engine has been shut down. Moreover, reference to a remote monitoring device means a device designed to provide the functionality described herein, namely to receive and display to an operator CO levels in a space of concern, based on data communicated from a CO detection device. Finally, reference to a CO detection device being in circuit communication with a remote monitoring device means that whatever is between CO detection device and remote monitoring device has as its primary function to establish and maintain (for as long as necessary) communication between the CO detection device and the remote monitoring device (as opposed to providing its own distinct functionality to a system). Thus, the concept of a CO detection device being in circuit communication with a remote monitoring device is intended to exclude a device like the base station of U.S. Pat. No. 6,930,599 that provides primary functionality to signals it receives from a sensor and from a camera, and then communicates with other system components such as a central station.

Accordingly, the foregoing disclosure provides a sensing device that can provide remote monitoring of a space of concern, and which is especially useful in connection with an aircraft cockpit. With the foregoing disclosure in mind, it is believed that various adaptations of a sensing device, designed for remote monitoring of a space of concern, according to the principles of the present invention, will be apparent to those in the art.

The invention claimed is:

1. A sensing device for detecting the presence of carbon monoxide in a selected space of concern, comprising (a) a detection device configured to sense the presence of carbon monoxide in the selected space of concern, (b) a monitoring device remote from the detection device, for communicating information to an operator, and (c) the detector in circuit communication with the monitoring device, to transmit information from the detection device to the monitoring device that is related to carbon monoxide in the selected space, wherein the monitoring device comprises a multifunctional display that is configured to display information about the level of carbon monoxide detected by the detection device in a plurality of display formats, the multifunctional display configured to enable a reset/retest of the level of carbon monoxide in the space of concern to be selectively initiated from the multifunctional display to retest and redisplay information about the level of carbon monoxide detected by the detection device in the plurality of display formats.

2. A sensing device as set forth in claim 1, wherein a reset/confirmation actuator is connected with the multifunctional display, and is in circuit communication with the detection device, the reset/confirmation actuator being selectively actuated from the multifunctional display to send a reset/confirmation signal to the detection device, to reset the detection device, and to initiate operation of the detection device to repeat its carbon monoxide detection process and provide a signal related to the level of carbon monoxide detected by the detection device.

3. A sensing device as set forth in claim 2, wherein the detection device includes a CO detection component and a heating element proximate to the detection component, the heating element being selectively actuated to heat the air space about the detection component.

4. A sensing device as set forth in claim 3, including an adjustment device for adjusting the output of the detection device in response to the air pressure in the selected space of concern.

5. A sensing device as set forth in claim 4, wherein the sensing device, including the detection device and the remote multifunctional display, is configured for a vehicle.

6. A sensing device as set forth in claim 4, wherein the sensing device, including the detection device and the remote multifunctional display, is configured for an aircraft.

7. A device as set forth in claim 1, wherein the detection device is configured to communicate with the multifunctional display along an RS232 communication cable.

8. A device as set forth in claim 1, wherein the detection device is configured to output a voltage that is related to the level of carbon monoxide in the selected space of concern.

9. A device as set forth in claim 1, further including an auxiliary device that is in circuit communication with the detection device and is actuated via a communication from the detection device to initiate a function that is related to the detection of carbon monoxide by the detection device; the circuit communication between the detection device and the monitoring device configured to enable the monitoring device to selectively communicate a signal with the detection device that causes the detection device to actuate the auxiliary device to initiate the function.

10. A device for detecting the presence of carbon monoxide in a selected space of concern in an aircraft, comprising (a) a detection device configured to sense the presence of carbon monoxide in the selected space of concern, (b) a monitoring device located in a multifunctional display remote from the detection device, for communicating information to an operator of the aircraft, where the multifunctional display is configured to display information about the level of carbon monoxide detected by the detection device in a plurality of display formats related to the detection of carbon monoxide in the selected space, and (c) the detection device in circuit communication with the monitoring device, to transmit information from the detection device to the monitor that is related to carbon monoxide in the selected space, and the multifunctional display configured to enable a reset/retest of the level of carbon monoxide in the space of concern to be selectively initiated from the multifunctional display to retest and redisplay information about the level of carbon monoxide detected by the detection device in the plurality of display formats.

11. A device as set forth in claim 10, wherein a Reset/confirmation actuator is connected with the multifunctional display, and is in circuit communication with the detection device, the reset/confirmation actuator being selectively actuated from the multifunctional display to send a reset/confirmation signal to the detection device, to selectively reset the detection device, and to initiate operation of the detection device to repeat its carbon monoxide detection process and provide a signal related to the level of carbon monoxide detected by the detection device.

12. A device as set forth in claim 11, wherein the detection device includes a carbon monoxide detection component, and a heating element proximate to the carbon monoxide detection component, the heating element being selectively actuated to heat the air space about the carbon monoxide detection component.

13. A device as set forth in claim 12, including an adjustment device associated with the detection device, for accounting for changes in the sensitivity of the detection device in response to changes in the air pressure in the selected space of concern.

14. A device as set forth in claim 10, wherein the sensor is configured to communicate information along an RS232 communication cable.

15. A device as set forth in claim 11, further including an auxiliary device that is in circuit communication with the detection device and is actuated via a communication from the detection device to initiate a function that is related to the detection of carbon monoxide by the detection device; the circuit communication between the detection device and the monitoring device configured to enable the monitoring device to selectively communicate a signal with the detection device that causes the detection device to actuate the auxiliary device to initiate the function.

16. A device as set forth in claim 10, including an electrical power source for detection device, and a communication between the electrical power source and the detection device that is maintained when the aircraft propulsion system is shut down, so that the detection device is kept in an alive condition even when the aircraft propulsion system is shut down.

17. A carbon monoxide detection device for connection to a remote monitoring device, comprising a housing that includes (a) a carbon monoxide detection component configured to sense the presence of carbon monoxide and to provide an output related thereto, and (b) a coupling for establishing circuit communication with a remote monitoring device that comprises a multifunctional display that displays information about the level of carbon monoxide detected by the detection device in a plurality of display formats, to enable transmission of information from the carbon monoxide detection component to the monitoring device that is related to carbon monoxide detected by the carbon monoxide detection component and display of the information about the level of carbon monoxide detected by the detection device in the plurality of display formats, and the multifunctional display is configured to enable a reset/retest of the level of carbon monoxide in the space of concern to be selectively initiated from the multifunctional display to retest and redisplay information about the level of carbon monoxide detected by the detection device in the plurality of display formats.

18. A carbon monoxide detection device as set forth in claim 17, wherein the coupling includes an input port for receiving a control signal from the multifunctional display, and the detection device is configured such that on receipt of a reset/confirmation signal at the input port the detection device provides a reset/confirmation function that resets the carbon monoxide detection component, and initiates operation of the carbon monoxide detection component to repeat its carbon monoxide detection process and provide a signal related to the level of carbon monoxide detected by the carbon monoxide detection component.

19. A carbon monoxide detection device as set forth in claim 17, further including a heating element proximate to the carbon monoxide detection component, the heating element being selectively actuatable to heat the air space about the carbon monoxide detection component.

20. A carbon monoxide detection device as set forth in claim 17, including an adjustment device for adjusting the output of the carbon monoxide detection component in response to the air pressure about the carbon monoxide detection component.

21. A carbon monoxide detection device as set forth in claim 17, wherein the coupling includes an input port for receiving a control signal from a remote monitoring device, and the coupling further includes a relay for communicating the carbon monoxide detection device with an auxiliary device to communicate a signal to the auxiliary device to initiate a function that is related to the detection of carbon monoxide by the carbon monoxide detection component; to enable a the monitoring device to selectively communicate a signal with the carbon monoxide detection device that causes the carbon monoxide detection device to transmit a signal to the relay for actuating the auxiliary device to initiate the function.

22. A carbon monoxide detection device as set forth in claim 21, wherein input port of the coupling comprises an RS232 port.

23. A carbon monoxide detection device as set forth in claim 18, wherein input port of the coupling comprises an RS232 port.

* * * * *

UNITED STATES PATENT AND TRADEMARK OFFICE

CERTIFICATE OF CORRECTION

PATENT NO. : 7,746,240 B2
APPLICATION NO. : 11/288716
DATED : June 29, 2010
INVENTOR(S) : Ashok K. Vij It is certified that error appears in the above-identified patent and that said Letters Patent is hereby corrected as shown below:

Column 13, line 30, change "11" to read "10".

Signed and Sealed this

Thirtieth Day of November, 2010

David J. Kappos

David J. Kappos
*Director of the United States Patent and Trademark Office*